US008640665B2

(12) United States Patent
Trump

(10) Patent No.: US 8,640,665 B2
(45) Date of Patent: Feb. 4, 2014

(54) METHOD FOR IGNITING FUEL USING A CORONA DISCHARGE

(75) Inventor: Martin Trump, Stuttgart (DE)

(73) Assignee: BorgWarner BERU Systems GmbH, Ludwigsburg (DE)

( * ) Notice: Subject to any disclaimer, the term of this patent is extended or adjusted under 35 U.S.C. 154(b) by 144 days.

(21) Appl. No.: 13/296,090

(22) Filed: Nov. 14, 2011

(65) Prior Publication Data

US 2012/0192825 A1 Aug. 2, 2012

(30) Foreign Application Priority Data

Dec. 21, 2010 (DE) ..... 10 2010 055 568

(51) Int. Cl.
*F02P 23/04* (2006.01)
*F02P 3/04* (2006.01)

(52) U.S. Cl.
USPC ..... 123/143 B

(58) Field of Classification Search
USPC ..... 123/594, 596, 598, 623, 143 B, 162, 123/606, 608
See application file for complete search history.

(56) References Cited

U.S. PATENT DOCUMENTS

| | | | | |
|---|---|---|---|---|
| 5,568,801 | A * | 10/1996 | Paterson et al. | 123/598 |
| 6,883,507 | B2 * | 4/2005 | Freen | 123/606 |
| 7,647,907 | B2 * | 1/2010 | Storm | 123/143 B |
| 2010/0147239 | A1 * | 6/2010 | Lu et al. | 123/169 R |
| 2011/0114071 | A1 | 5/2011 | Freen | |
| 2012/0063054 | A1 * | 3/2012 | Burrows et al. | 361/256 |
| 2012/0212313 | A1 * | 8/2012 | Burrows | 336/90 |

* cited by examiner

*Primary Examiner* — Stephen K Cronin
*Assistant Examiner* — Arnold Castro
(74) *Attorney, Agent, or Firm* — Hackler Daghighian & Martino

(57) ABSTRACT

The invention relates to a method for igniting a fuel/air mixture in a combustion chamber of a cyclically operating internal combustion engine using an ignition electrode constitutes a capacitance in cooperation with a wall of the combustion chamber that is at ground potential, wherein an electric oscillating circuit, which is connected to a secondary side of an electric DC/AC converter and the ignition electrode, is excited by way of a primary voltage applied to a primary side of the electric DC/AC converter, wherein the excitation of the oscillating circuit is controlled such that a corona discharge igniting the fuel/air mixture is created in the combustion chamber at the ignition electrode. According to the invention, the primary voltage is controlled to a specified setpoint value which is changed during the combustion duration of the corona discharge and is dependent upon the crankshaft angle and on at least one characteristic value of the fuel/air mixture.

11 Claims, 3 Drawing Sheets

METHOD FOR IGNITING FUEL USING A CORONA DISCHARGE

WO 2010/011838 A1 discloses how a fuel/air mixture can be ignited in a combustion chamber of an internal combustion engine by a corona discharge created in the combustion chamber. For this purpose an ignition electrode is used that extends in an electrically insulated manner through one of the walls, that are at ground potential, of the combustion chamber into the combustion chamber, preferably opposite a reciprocating piston provided in the combustion chamber. The ignition electrode constitutes a capacitance together with the walls of the combustion chamber that are at ground potential and function as counterelectrode. The combustion chamber and the contents thereof act as a dielectric. Air or a fuel/air mixture or exhaust gas is located therein, depending on which stroke the piston is engaged in.

The capacitance is a component of an electric oscillating circuit which is excited by a high-frequency voltage created using an electrical DC/AC converter, such as a transformer having a center tap. The transformer interacts with a switching device which applies alternately a specifiable DC voltage to the two primary windings of the transformer separated by the center tap. The secondary winding of the transformer supplies a series oscillating circuit comprising the capacitance constituted by the ignition electrode and the walls of the combustion chamber. The frequency of the alternating voltage which excites the oscillating circuit and is delivered by the transformer is controlled such that it is as close as possible to the resonance frequency of the oscillating circuit. The result is a voltage step-up between the ignition electrode and the walls of the combustion chamber in which the ignition electrode is disposed. The resonance frequency is typically between 30 kilohertz and 5 megahertz, and the alternating voltage reaches values at the ignition electrode of 10 kV to 500 kV, for example.

Thus corona discharge can be created in the combustion chamber. The corona discharge should not break down into an arc discharge or a spark discharge. Measures are therefore implemented to ensure that the voltage between the ignition electrode and ground remains below the voltage required for a complete breakdown. For this purpose, it is known from WO 2010/011838 A1 to measure the voltage and the current intensity at the input of the transformer and, on the basis thereof, to calculate impedance as the quotient of voltage and current intensity. The impedance calculated in this manner is compared to a fixed setpoint value for the impedance, which is selected such that the corona discharge can be maintained without the occurrence of a complete voltage breakdown.

SUMMARY OF THE INVENTION

This method has the disadvantage that the formation of the corona is not optimal and, in particular, an optimal size of the corona is not always attained. Specifically, the corona increases in size the closer the oscillating circuit is operated to the breakdown voltage. To ensure that the breakdown voltage is never reached, the setpoint value of the impedance that must not be exceeded must be so low that a voltage breakdown and, therefore, an arc discharge, is always prevented.

The problem addressed by the present invention is that of demonstrating how a larger corona discharge can be produced for igniting a fuel mixture and voltage overloads largely prevented.

This problem is solved according to the invention in that the primary voltage is controlled by a closed looped control to a setpoint value which is changed during the combustion duration of the corona discharge and is dependent upon the crankshaft angle and a characteristic value of the fuel/air mixture.

In the method according to the invention, the primary voltage is adapted during a corona discharge to changes in the breakdown voltage at which an arc discharge forms. The breakdown voltage is dependent upon the conditions in the combustion chamber. In addition to the crankshaft angle, by way of which the distance between the ignition electrode and the piston is determined, the fuel/air mixture itself is significant for the level of the breakdown voltage. Since the setpoint value of the primary voltage during the duration of the corona discharge is changed depending on the crankshaft angle and a characteristic value of the fuel/air mixture, such as the density thereof, the primary voltage can follow changes in the breakdown voltage. It is therefore possible to maintain an optimal distance of the primary voltage from the breakdown voltage during the entire duration of the corona discharge. According to the invention, the primary voltage can therefore be moved closer toward the breakdown voltage without the risk of a voltage breakdown being increased.

Advantageously, by way of a method according to the invention, it is possible to attain a corona size that is largely constant at a given operating point. Engine manufacturers typically specify, by way of program maps, when an ignition should optimally take place. Moments of ignition deviating therefrom, or corona discharges having different voltages typically result in reduced efficiency. According to the invention, a corona discharge that is optimal for the particular engine operating state can be produced. Quiet running of the engine can thereby be improved, and fuel consumption can be lowered.

The setpoint value is preferably specified by a program map. Values for the setpoint value can be entered in a program map for various values of the crankshaft angle and a characteristic value of the fuel/air mixture, such as the density or temperature thereof. The program map can be present as a matrix if only one characteristic value of the fuel/air mixture in addition to the crankshaft angle should be taken into account. The program map can also have a higher dimension, however, and account for a plurality of characteristic values of the fuel/air mixture. In particular, the program map can also account for the engine operating state and indicate, for example, the setpoint value also as a function of engine data such as engine speed and engine temperature. Advantageously, it is therefore also possible to quickly adapt the primary voltage to changed conditions when the engine operating point changes.

A program map that specifies the setpoint value of the primary voltage can be advantageously stored in a control device. The control device can be an engine control unit, for example, or a separate control device that communicates with the engine control unit. The program map can be stored by the manufacturer in the memory of the control device. If voltage overloads occur during operation, the setpoint value can be reduced and the program map can be easily adapted.

To create a program map, it is sufficient to determine the breakdown voltage as a function of the crankshaft angle and the characteristic value(s) of the fuel/air mixture to be taken into account. This can take place during operation of the engine by incrementally increasing the primary voltage until a voltage overload occurs, or by incrementally lowering the primary voltage until a voltage overload no longer forms. The limit value of the primary voltage when voltage overload occurs is the breakdown voltage. It is advantageous in particular that the program map per se need be determined only once and can therefore take place in an automated manner on a test stand. Interfering arcs in subsequent engine operation can therefore be largely prevented.

A voltage overload manifests as an abrupt increase in the current and can therefore be easily identified by performing a current and voltage measurement, or an impedance measurement. Preferably, a renewal of the program map can also be prompted, e.g. after a defined number of engine operating hours or a specified number of corona discharges have passed, or by way of a related command, e.g. from the engine control unit. In this context, "renewal of the program map" means that the setpoint values specified by the program map are redetermined and stored as a function of the crankshaft angle and at least one characteristic value of the fuel/air mixture.

The engine geometry, such as stroke, bore, and/or connecting rod length, can also be taken into account using related mathematical formulas when creating the program map. In particular, the influence of the piston position and the dependence of the fuel/air mixture can also be determined via computation using a characteristic curve.

The characteristic value of the fuel/air mixture used to control the primary voltage, with which the setpoint value is determined, can be measured directly or determined from engine operating data. For example, the density of the fuel/air mixture can be calculated at least approximately on the basis of the charge air pressure, the throttle valve position, the air mass, the fuel mass, the intake temperature, and/or the compression ratio.

BRIEF DESCRIPTION OF THE DRAWINGS

Further details and advantages of the invention are explained using an embodiment, with reference to the attached drawings.

DETAILED DESCRIPTION

Figure 1:
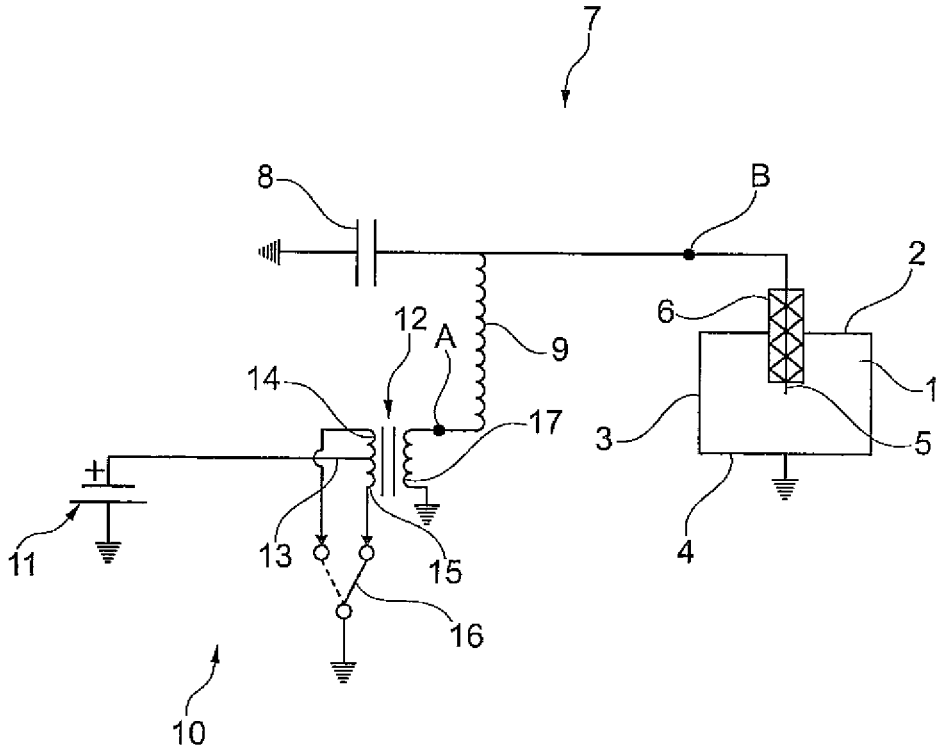
FIG. 1 shows a schematic depiction of the design of an ignition system for a vehicle engine.

FIG. 1 shows a combustion chamber 1 which is delimited by walls 2, 3, and 4 that are at ground potential. An ignition electrode 5 which is enclosed by an insulator 6 along a portion of the length thereof extends into the combustion chamber 1 from above, and is guided through the upper wall 2 into the combustion chamber 1 in an electrically insulated manner by way of said insulator. The ignition electrode 5 and the walls 2 to 4 of the combustion chamber 1 are part of a series oscillating circuit 7 which also includes a capacitor 8 and an inductor 9. Of course, the series oscillating circuit 7 can also comprise further inductors and/or capacitors, and other components that are known to a person skilled in the art as possible components of series oscillating circuits.

A DC/AC converter is provided for excitation of the oscillating circuit 7, which in the example shown is formed by a high-frequency generator 10 comprising a DC voltage source 11 and a transformer 12 having a center tap 13 on the primary side thereof, thereby enabling two primary windings 14 and 15 to meet at the center tap 13. To produce a corona discharge, a primary voltage is applied to the DC/AC converter, namely at the center tap 13. The primary voltage can be generated from the voltage of the DC voltage source 11, e.g. using a method of pulse-width modulation, and can thereby be adjusted to a desired value.

Using a high-frequency switch 16, the ends of the primary windings 14 and 15 opposite the center tap 13 are connected to ground in alternation. The switching rate of the high-frequency switch 16 determines the frequency with which the series oscillating circuit 7 is excited, and can be changed. The secondary winding 17 of the transformer 12 supplies the series oscillating circuit 7 at the point A. The high-frequency switch 16 is controlled using a not-shown closed control loop such that the oscillating circuit is excited with the resonance frequency thereof. The voltage between the tip of the ignition electrode 5 and the walls 2 to 4 that are at ground potential is therefore at a maximum.

Figure 2:
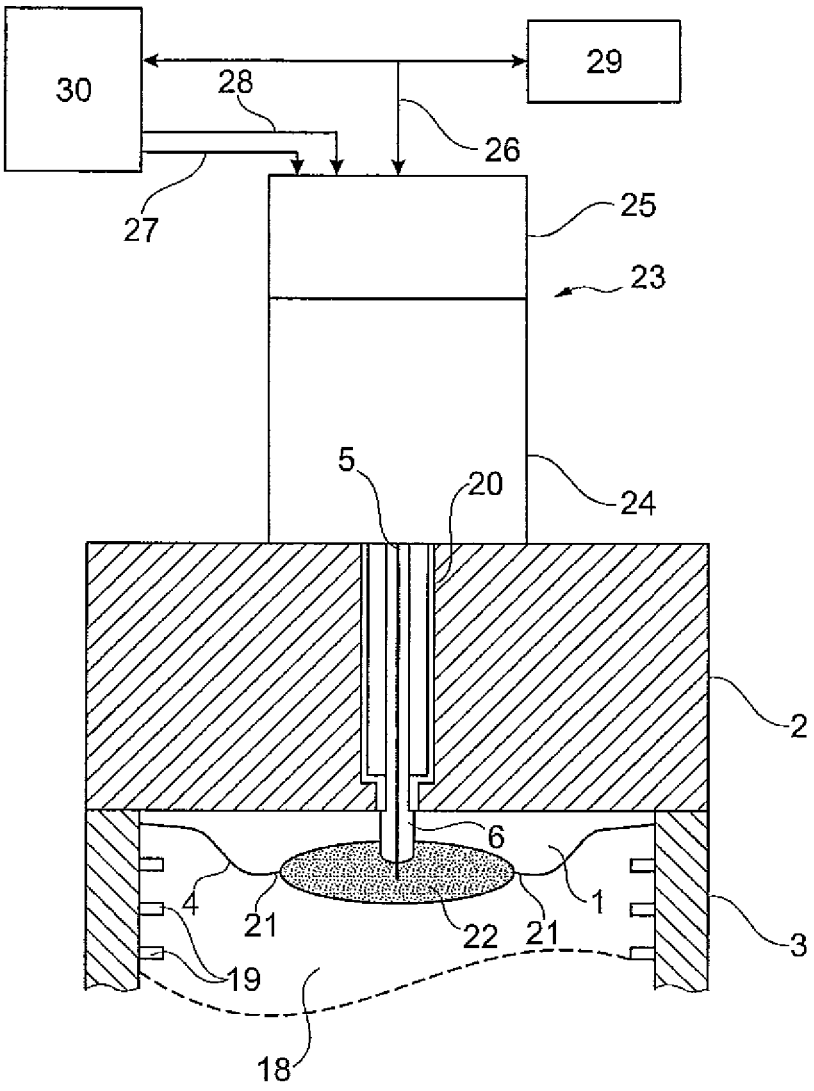
FIG. 2 shows, schematically, a longitudinal cross section of a cylinder of an internal combustion engine, which is connected to the ignition system shown in FIG. 1.

FIG. 2 shows a longitudinal cross section of a cylinder of an internal combustion engine equipped with the ignition device depicted schematically in FIG. 1. The combustion chamber 1 is limited by an upper wall 2 in the form of a cylinder head, a cylindrical circumferential wall 3, and the top side 4 of a piston 18 which is equipped with piston rings 19 and can move back and forth in the cylinder.

The cylinder head 2 comprises a passage 20 through which the ignition electrode 5 extends in an electrically insulated and sealed manner. The ignition electrode 5 is enclosed along at least a portion of the length thereof by an insulator 6 which may be a sintered ceramic, e.g. an aluminium oxide ceramic. The ignition electrode 5 extends via the tip thereof into the combustion chamber 1 and extends slightly past the insulator 6, although it could be flush therewith or even covered with a thin layer of insulating material.

A few sharp-edged projections 21 can be provided on the top side of the piston 18 in the environment of the tip of the ignition electrode 5, which are used to locally increase the electric field strength between the ignition electrode 5 and the piston 18 situated opposite thereto. When the oscillating circuit 7 is excited, a corona discharge forms primarily in the region between the ignition electrode 5 and optionally provided projections 21 of the piston 18, and can be accompanied by a more or less intensive charge carrier cloud 22.

A housing 23 is placed onto the outer side of the cylinder head 2. The primary windings 14 and 15 of the transformer 12, and the high-frequency switch 16 interacting therewith, are located in a first compartment 24 of the housing 23. A second compartment 25 of the housing 23 contains the secondary winding 17 of the transformer 12 and the remaining components of the series oscillating circuit 7, and, optionally, means for observing the behavior of the oscillating circuit 7. An interface 26 can be used to establish a connection, for example, to a diagnostic unit 29 and/or an engine control unit 30.

Figure 3:
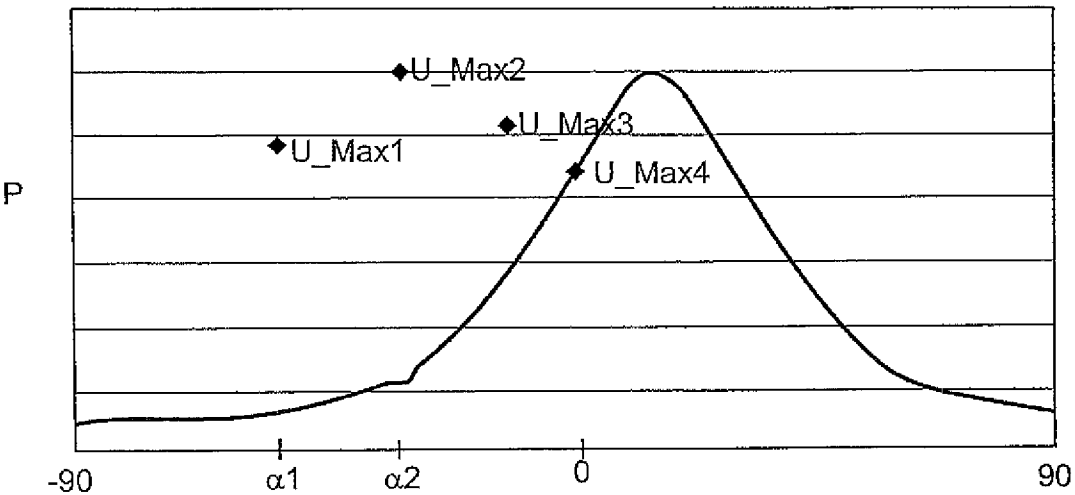
FIG. 3 shows, schematically, the course of cylinder pressure and the breakdown voltage as a function of the crankshaft angle.

FIG. 3 shows, schematically, an example of the course of cylinder pressure p (solid line) and four values, as examples, of the breakdown voltage as a function of the crankshaft angle. In FIG. 1, the left y-axis indicates the cylinder pressure in arbitrary units, and the right y-axis indicates the voltage in arbitrary units.

Before top dead center, i.e. crankshaft angle 0, the breakdown voltage increases initially in an early region between a crankshaft angle $\alpha 1$ and a crankshaft angle $\alpha 2$ and reaches a maximum clearly before top dead center. Starting from this maximum value, the breakdown voltage decreases. The maximum permissible primary voltage that can be applied to the primary side of the DC/AC converter to create a corona discharge without producing a voltage breakdown naturally takes the same course as the breakdown voltage.

The breakdown voltage and, therefore, the maximum permissible primary voltage used to produce a corona discharge is dependent not only on the crankshaft angle, but also on the fuel/air mixture itself, in particular on the density thereof. The course of the breakdown voltage as a function of the crankshaft angle can be determined for one or more characteristic values of the fuel/air mixture and can be stored as a program map. Instead of the breakdown voltage, it is also possible to enter in such a program map the particular maximum permissible primary voltage which results in ignition of a corona discharge without voltage overloads and can therefore be used advantageously to control the primary voltage. To prevent voltage overloads to the greatest extent possible, a value is preferably used as the setpoint value that falls below the maximum permissible primary voltage, e.g. by a specified absolute or relative value. The absolute value can be indicated in mV, for example, and the relative value can be indicated in %, for example.

Using such a program map, the primary voltage can be controlled during the duration of a corona discharge to a setpoint value that is dependent upon the crankshaft angle and at least one characteristic value of the fuel/air mixture, such as the density thereof. The setpoint value can be selected as the maximum value of the primary voltage, at which a sample discharge is not yet ignited, or as a voltage value that has a specified distance from the breakdown voltage.

Depending on the moment of ignition relative to the crankshaft angle, the primary voltage is increased by way of the method described during the duration of the corona discharge, e.g. between the crankshaft angle $\alpha_1$ and $\alpha_2$, or lowered, e.g. after the crankshaft angle $\alpha_2$. In this manner a voltage overload and, therefore, ignition of an arc discharge can be prevented and a maximum corona discharge can be generated.

The characteristic value used to determine the setpoint value can be calculated, for example, on the basis of the charge air pressure, the throttle valve position, the air mass, the fuel mass, the intake temperature, the compression ratio or another engine operating parameter. Preferably the setpoint value is also specified as a function of engine operating data, preferably the speed and/or engine temperature.

In the case of higher dimensional program maps in particular, it can be advantageous to determine the change in the setpoint value during the combustion duration of a corona discharge on the basis of fewer variables than are used to determine the setpoint value for igniting the corona discharge. For example, the setpoint values for igniting the corona discharge can be entered in a program map as a function of a plurality of variables, and the changes in the setpoint value during the combustion duration of the corona discharge can be calculated on the basis of a reduced number of variables. In the simplest case, the change in the setpoint value during the combustion duration of the corona discharge is calculated only on the basis of the crankshaft angle.

What is claimed is:

1. A method for igniting a fuel/air mixture in a combustion chamber of a cyclically operating internal combustion engine using an ignition electrode which constitutes a capacitance in cooperation with a wall of the combustion chamber that is at ground potential, the method comprising:

exiting an electric oscillating circuit, which is connected to a secondary side of an electric DC/AC converter and the ignition electrode, by way of a primary voltage applied to a primary side of the electric DC/AC converter;

controlling the excitation of the oscillating circuit in order that a corona discharge igniting the fuel/air mixture is created in the combustion chamber at the ignition electrode; and controlling the primary voltage to a specified setpoint value which is changed during the duration of the corona discharge and is dependent upon a crankshaft angle and on at least one characteristic value of the fuel/air mixture, wherein the characteristic value is calculated on the basis of at least one of the following: air mass or fuel mass.

2. A method for igniting a fuel/air mixture in a combustion chamber of a cyclically operating internal combustion engine using an ignition electrode which constitutes a capacitance in cooperation with a wall of the combustion chamber that is at ground potential, the method comprising:

exiting an electric oscillating circuit, which is connected to a secondary side of an electric DC/AC converter and the ignition electrode, by way of a primary voltage applied to a primary side of the electric DC/AC converter;

controlling the excitation of the oscillating circuit in order that a corona discharge igniting the fuel/air mixture is created in the combustion chamber at the ignition electrode; and controlling the primary voltage to a specified setpoint value which is changed during the duration of the corona discharge and is dependent upon a crankshaft angle and on at least one characteristic value of the fuel/air mixture, wherein the characteristic value of the fuel/air mixture comprises a density thereof, and wherein the setpoint value is increased during the duration of the corona discharge if a breakdown voltage increases during the duration of the corona discharge.

3. The method according to claim 2, wherein the density is calculated on the basis of at least one of the following: charge air pressure, throttle valve position, air mass, fuel mass, intake temperature, compression ratio.

4. The method according to claim 2, wherein the setpoint value is a function of one or more engine operating data.

5. The method according to claim 2, wherein the setpoint value is a function of engine speed.

6. The method according to claim 2, wherein the setpoint value is a function of engine temperature.

7. The method according to claim 2, wherein the setpoint value is a program map.

8. The method according to claim 7, wherein, if a voltage overload occurs, the setpoint value is reduced and the program map is adapted.

9. The method according to claim 7, wherein the program map is renewed after a specified number of corona discharges.

10. The method according to claim 2, wherein the setpoint value is reduced during the duration of the corona discharge if the breakdown voltage decreases during the duration of the corona discharge.

11. A method for igniting a fuel/air mixture in a combustion chamber of a cyclically operating internal combustion engine using an ignition electrode which constitutes a capacitance in cooperation with a wall of the combustion chamber that is at ground potential, the method comprising:

exiting an electric oscillating circuit, which is connected to a secondary side of an electric DC/AC converter and the ignition electrode, by way of a primary voltage applied to a primary side of the electric DC/AC converter;

controlling the excitation of the oscillating circuit in order that a corona discharge igniting the fuel/air mixture is created in the combustion chamber at the ignition electrode; and controlling the primary voltage to a specified setpoint value which is changed during the duration of the corona discharge and is dependent upon a crankshaft angle and on at least one characteristic value of the fuel/air mixture, wherein the characteristic value of the fuel/air mixture is the density thereof, and wherein the setpoint value is reduced during the duration of the corona discharge if the breakdown voltage decreases during the duration of the corona discharge.

* * * * *